US008904949B2

(12) United States Patent
Meling et al.

(10) Patent No.: US 8,904,949 B2
(45) Date of Patent: Dec. 9, 2014

(54) DISCONNECTABLE PRODUCTION DOCK (DPD) FOR TURRET FREE DISCONNECTABLE WEATHER VANING FPSO

(75) Inventors: Trond Stokka Meling, Sola (NO); Arnt Olufsen, Trondheim (NO)

(73) Assignee: Statoil Petroleum AS, Stavanger (NO)

( * ) Notice: Subject to any disclaimer, the term of this patent is extended or adjusted under 35 U.S.C. 154(b) by 491 days.

(21) Appl. No.: 13/127,372

(22) PCT Filed: Nov. 2, 2009

(86) PCT No.: PCT/NO2009/000380

§ 371 (c)(1),
(2), (4) Date: Jul. 13, 2011

(87) PCT Pub. No.: WO2010/062182

PCT Pub. Date: Jun. 3, 2010

(65) Prior Publication Data

US 2011/0263169 A1 Oct. 27, 2011

(30) Foreign Application Priority Data

Nov. 3, 2008 (NO) ..... 20084622

(51) Int. Cl.

| | |
|---|---|
| ***B63B 21/50*** | (2006.01) |
| ***B63B 22/02*** | (2006.01) |
| *B63B 21/00* | (2006.01) |

(52) U.S. Cl.

CPC ..... *B63B 21/50* (2013.01); *B63B 22/02* (2013.01); *B63B 2021/004* (2013.01)

USPC ..... 114/230.1; 114/230.13; 441/4

(58) Field of Classification Search

CPC .... B63B 22/02; B63B 22/021; B63B 22/023; B63B 22/025; B63B 22/026; B63B 21/50; B63B 21/507; B63B 21/508; B63B 2021/001; B63B 2021/004

USPC ..... 114/230.1, 230.13–230.2; 441/3–5

See application file for complete search history.

(56) References Cited

U.S. PATENT DOCUMENTS 4,150,636 A * 4/1979 Lundh ..... 114/230.1
4,331,097 A * 5/1982 Belinsky ..... 114/230.15

(Continued)

FOREIGN PATENT DOCUMENTS

CN 1780961 A 5/2006
EP 1 428 748 A1 6/2004

(Continued)

*Primary Examiner* — Ajay Vasudeva

(74) *Attorney, Agent, or Firm* — Birch, Stewart, Kolasch & Birch, LLP

(57) ABSTRACT

System for mooring a large vessel for production of hydrocarbons, such vessel for example being a FPSO vessel, the mooring system including at least two floating bodies of the hang-off type, moored by means of differentiated compliance spread anchoring system to the sea bed, allowing partly weathervaning of the large vessel; a riser system extending from the sea bed to each the floating bodies, and means for transfer of fluids from the two floating bodies to the large vessel, the floating bodies and the large vessel being provided with locking means, locking floating bodies to the large vessel at the bow and the stern of the vessel in a mechanically rigid manner, thus providing a integrated, rigidly fixed unit comprising the large vessel and the floating bodies.

6 Claims, 4 Drawing Sheets

(56) References Cited

U.S. PATENT DOCUMENTS

| | | | | |
|---|---|---|---|---|
| 7,287,484 | B2 * | 10/2007 | Landry et al. | 114/230.1 |
| 7,426,897 | B2 * | 9/2008 | De Baan | 114/230.1 |
| 7,886,679 | B2 * | 2/2011 | De Baan | 114/230.2 |
| 7,975,769 | B2 * | 7/2011 | Pollack et al. | 166/350 |
| 2005/0152747 | A1 | 7/2005 | Commander et al. | |
| 2005/0204987 | A1 | 9/2005 | Baan | |
| 2008/0070456 | A1 | 3/2008 | Olsen et al. | |

FOREIGN PATENT DOCUMENTS

| | | | | | |
|---|---|---|---|---|---|
| GB | 2191462 | A | * | 12/1987 | B67D 5/68 |
| WO | WO 00/27692 | A1 | | 5/2000 | |
| WO | WO 2004/074085 | A1 | | 9/2004 | |
| WO | WO 2004/099508 | A2 | | 11/2004 | |
| WO | WO 2005/118389 | A1 | | 12/2005 | |
| WO | WO 2007/071647 | A2 | | 6/2007 | |
| WO | WO 2008/122312 | A1 | | 10/2008 | |

* cited by examiner

DISCONNECTABLE PRODUCTION DOCK (DPD) FOR TURRET FREE DISCONNECTABLE WEATHER VANING FPSO

TECHNICAL FIELD OF THE INVENTION

The present invention relates to a system for mooring a large vessel for production of hydrocarbons, such vessel for example being a FPSO vessel, and comprising a mooring system

BACKGROUND OF THE INVENTION

It is well known to use large vessels, moored to the sea bed, serving for example as a floating FPSO vessel for Production, Storage and Off-loading of hydrocarbons offshore. Such vessel may be moored by means of a turret system, allowing the FPSO to weathervane, dependent upon the direction of waves, wind or currents. Alternatively such vessel may use a mooring system consisting of a large number of mooring lines, arranged in a catenary spread.

WO 2005/118389 describes a method for dynamic positioning of a vessel, wherein a positioning system controls at least one positioning machinery, and where two or more buoys, each comprising at least one positioning machinery are coupled to the vessel.

US 2008070456 describes a method of dynamic positioning of a vessel, wherein a positioning system controls at least one positioning machinery, and where two or more buoys, each comprising at least one positioning machinery, are coupled to the vessel.

WO 2004/074085 describes a device for loading and unloading a vessel, wherein a loading pipe or a loading hose is connected to the vessel via a floating, self-moored coupling unit designed to be moored to the vessel, preferably near the manifold of the vessel. The coupling unit has sufficient propulsive capacity to maintain the vessels position during the loading operation.

WO 00/27692 describes a device for positioning of vessels, such as ships, barges, semi-submersibles or the like, during operations, such as drilling, production or geological operations. The device consists of a single floating structure whose vertical position in the sea can be regulated and is anchored to the sea bed via a number of anchoring lines.

Problems associated with prior art solutions are limited capacity with turret/swivel system (ref. weather vaning); line interference due to the use of a large number of lines into congested area (mooring, umbilicals, power cables, risers); and high capital investment costs Further, it should be appreciated that existing dis-connectable systems have less capacity than permanent turret moored systems.

SUMMARY OF THE INVENTION

An object of the present invention is to provide a system allowing a quick disconnection of the moored vessel in case of extreme weather conditions, such as for example a suddenly appearing hurricane in the Gulf of Mexico.

Another object of the invention is to allow the vessel to partly weathervane without being dependent upon a turret, in case of changing direction of the environmental forces.

A further object of the invention is to provide a system, where the vessel is independent of a mooring system.

Another object of the present invention is to combine the advantages from a spread moored system having a large hang-off area with the ability to partly weathervane and to be able to quickly disconnect in case of extreme weather conditions.

A still further object of the present invention is to provide a floating structure creating stiff body motion in a disconnected mode.

A further object of the invention is to provide a locking mechanism which may easily be accessible and easy to maintain, imposing forces on the hull of the large vessel at reinforced, pre-designed sections only.

The objects according to the present invention are achieved by means of a system and a method for mooring as further defined by the independent claims. Embodiments of the inventions are defined by the dependent claims.

The system according to the present invention is partly based on use of existing principles/technology elements, but with quite different application, e.g. with respect to load transfer, production capacities, etc. for a weathervaning floating unit.

It combines the advantages from a spread moored system that has a large hang-off area with the ability to partly weathervane and to be disconnected in case of extreme weather conditions.

According to the present invention, the system for mooring a large vessel for production of hydrocarbons, such vessel for example being a FPSO vessel, is provided. The mooring system comprising at least two floating bodies moored by means by means of differentiated compliance spread anchoring system to the sea bed, allowing partly weather-vaning of the large vessel. Further, the system comprises a riser system extending from the sea bed to each the floating bodies, and means for transfer of fluids from the at least two floating bodies to the large vessel, the floating bodies and the large vessel being provided with locking means, locking floating bodies to the large vessel at the bow and the stern of the vessel by means of a mechanically rigid connection means, thus providing an integrated, rigidly fixed part of the large vessel during the operation phase.

The large vessel and the floating bodies may be rigidly interconnected by means of a releasable groove and tongue connection, forming a temporary rigid body motion preventing interconnection.

The groove may preferably be arranged on the large vessel and the corresponding tongue may be arranged on the floating bodies, the groove being open downwards and the tongue being in the form of an upwards extending fin or flange, designed to be in locking engagement with the groove.

The floating body may be provided with a fluid transfer system communicating with a corresponding fluid transfer system on the large vessel, the fluid transfer system being of the a quick release hard pipe system provided with flanges/hinges.

Four floating bodies may be used, said floating bodies being rigidly interconnected by longitudinal, transverse bracings together with a truss work interconnecting pairs of diametrically positioned floating bodies.

In order to moor a large floating vessel to at least two floating bodies wherein each of the floating bodies being moored to the sea bed by means of a plurality of mooring lines, the large floating vessel is brought in a position adjacent to or between the at least two floating bodies, whereupon the floating bodies are pulled in towards, for example by means of hawsers, and fixed to the large vessel by de-ballasting the floating bodies, so that the tongue engages with the groove on the large vessel, establishing a fixed interconnection of the vessel and the floating bodies, thus establishing a spread mooring for the large vessel.

According to the present invention, a significantly larger area for connecting lines, such as risers, umbilicals, HV power, etc., is provided.

Hence, it allows for much higher production and power supply for the subsea production systems, allowing use of increased number of production risers, umbilicals and power supply cables compared with the prior art FPSO vessels. Hence, such unit may be used at larger fields with higher production. In addition, the production may be increased since a larger number of pumps and/or larger pumps may be applied. In order to achieve the same result using prior art FPSO-solutions, two or more FPSO vessels must be used.

Further, the system allows partly weathervaning without use of a turret/swivel system.

Potential cost savings may also be achieved since a more flexible mooring procedure and extension of the weather window in which the system may operate, is prolonged. According to the present invention, the capital expenditure (capex) and the operation expenditure (opex) may be reduced.

Further, the solution according to the present invention is particularly suitable for use in areas prone to hurricanes and typhoones. Hence, the solution is particularly, but not exclusively, suitable for use in the Gulf of Mexico or in Asia and off the coast of China.

The present solution also allows use of several alternative riser systems, for example free hanging risers, flexible risers, steel catenary risers (SCR), pipe in pipe risers (PIP), riser tower solutions, etc.

A further major advantage is that the system according to the present invention is flexible with respect to installation. For example, installation of risers, etc. may be done independent of the presence of the production vessel, such degree of freedom being of great significance in the installations phase at the field.

Further, the access to the risers, etc. for inspection maintenance, repair, etc. is also greatly improved and simplified, reducing the operational costs and minimizing down time of the production system, while operations and handling through a conventional swivel/turret impose large limitations and requirements for closing down the production in more than one riser, i.e. loss of production.

Compared to a typical "mono-hull" FPSO, the disconnection procedure and operations are greatly improved, having positive impact both on costs and safety.

According to the present invention, it may be feasible to use various types of riser configuration, either in combination or with one category for a single FPSO. Compared to prior art solutions, where it may be difficult to hang off a steel catenary riser in a turret/swivel solution due to the stiffness of the riser pipe during installation, the degree of operational freedom is improved.

Further, according to the present invention, a rigid connection between the vessel and the floater(s) may be achieved, whereby the vessel and the floater(s) may function as a single, integrated floating body.

SHORT DESCRIPTION OF THE DRAWINGS

In the following an embodiment of the invention will be described in further details, referring to the drawings, wherein.

DESCRIPTION OF THE INVENTION

Figure 1:
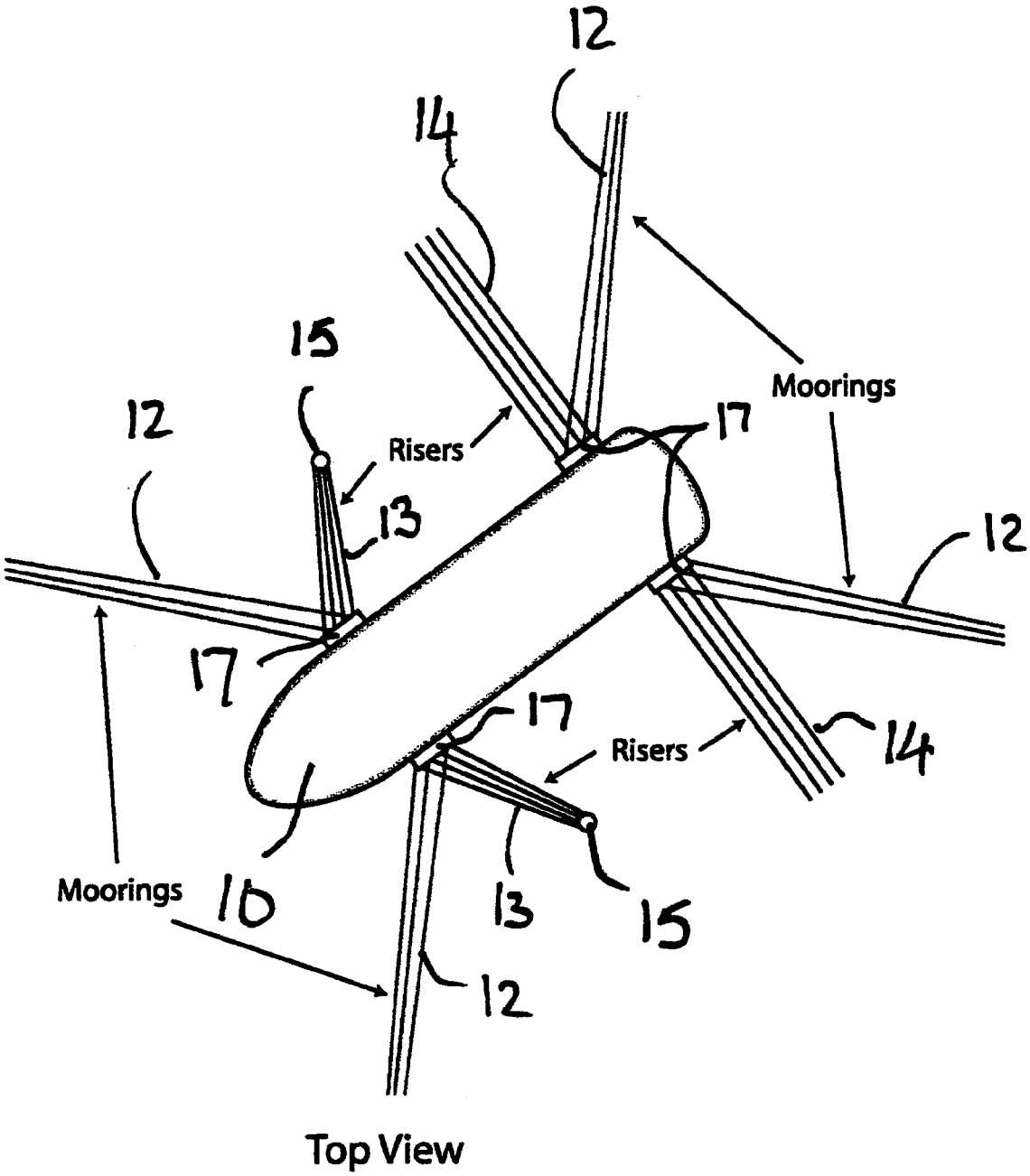
FIG. 1 shows a top view of a vessel for production of hydrocarbons such as oil and gas through a riser system, the vessel being moored to the sea bed by means of a mooring system.

FIG. 1 shows schematically a top view of a vessel 10 for production of hydrocarbons, such as oil and/or gas. The vessel 10 is moored to a sea bed 11 by means of a spread mooring comprising two front set of mooring lines 12 extending downwards and outwards from the bow of the vessel 10, and two corresponding aft set of mooring hawsers extending downwards and outwards from the rear of the vessel 10.

Figure 2:
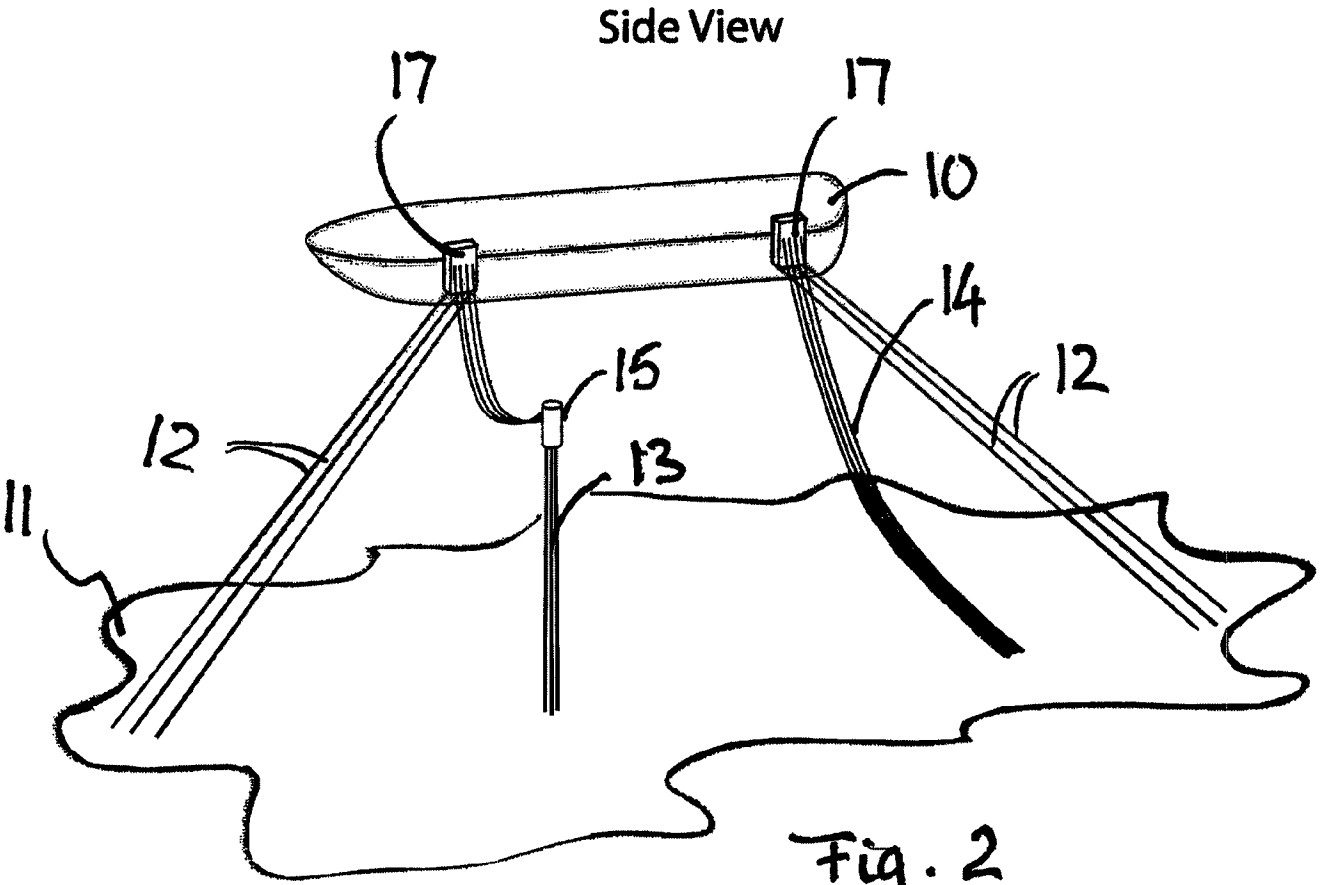
FIG. 2 shows a view in perspective of the vessel shown in FIG. 1, showing both types of riser systems 13, 14.

Further, as shown both in FIGS. 1 and 2, the vessel 10 is provided with four sets of risers 13, 14, extending between the sea bed 11 and the vessel 10. Two of the sets of risers 13 are provided with a submerged buoy 15 to compensate for possible vertical and/or horizontal motion of the vessel 10. The risers 13, 14 are attached to the vessel 10 by means of a riser attachment arrangement 17.

Figure 3:
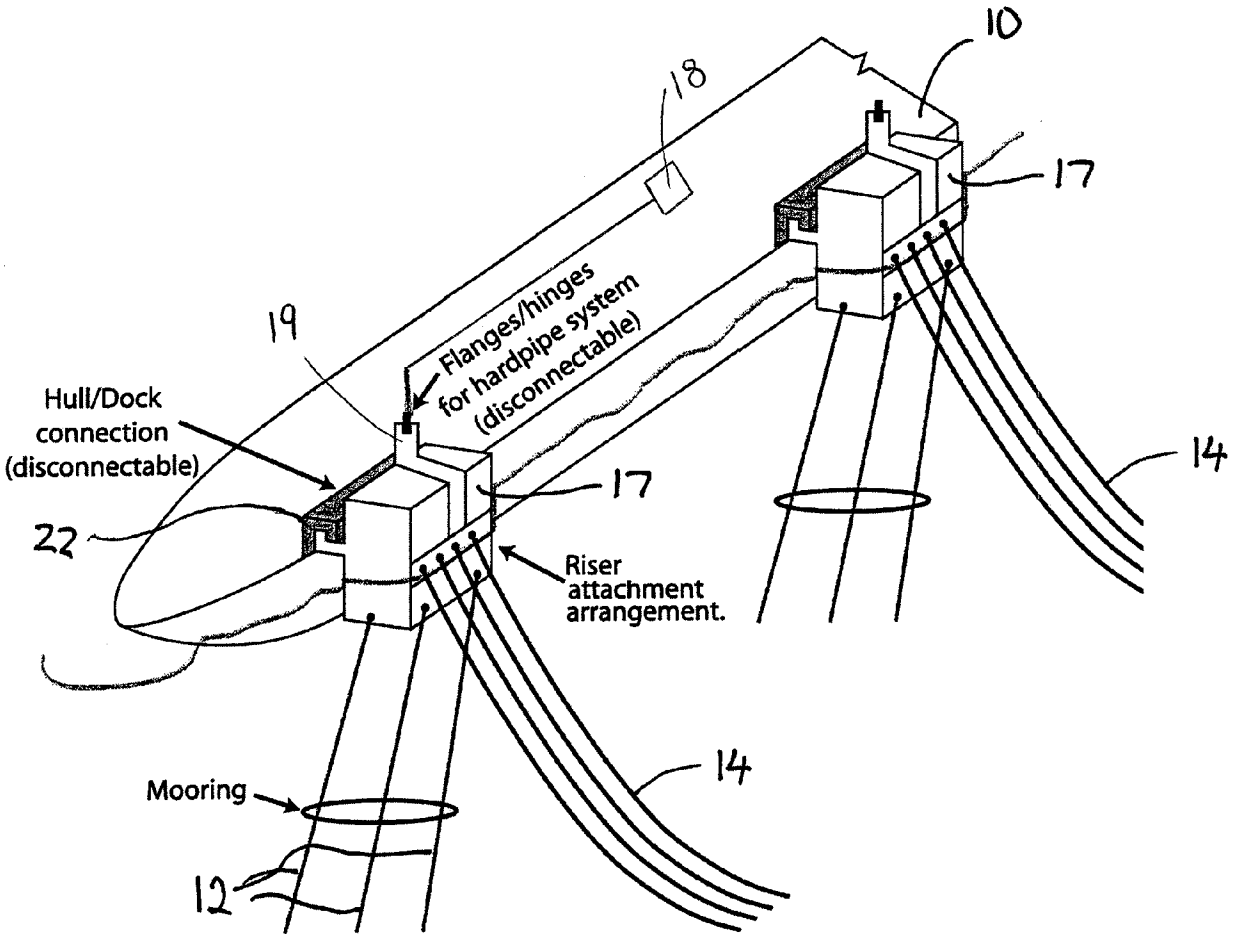
FIG. 3 shows a view in perspective of a vessel provided with a floating dock riser and mooring system according to the present invention.

FIG. 3 shows schematically in perspective a hull 10 provided with a hull/dock connection 16 and a floating dock 17, such floating dock 17 being moored to the sea bed by means of several dock moorings 12. The floating dock 17 is in the form of a buoyant body. Further, several risers 13, 14 are terminated at the deck of the floating dock 17. Further, the system comprises a fluid transfer system 19 for transfer of the hydrocarbons from the riser termination on the deck of the floating dock to the vessel 10. The fluid transfer system 19 is in communication with a corresponding fluid transfer system 18 on the vessel 10, the fluid transfer system 19 being of the a quick release hard pipe system provided with flanges/hinges.

The vessel 10 is provided with attachment means 16, rigidly fixed to the hull side of the vessel 10. Such attachment means 16 may for example be in the form of a groove type connection, while the floating dock is provided with a corresponding tongue means rigidly fixed to the floating dock 17, the two connecting means thereby providing a groove and tongue connection of a rigid type, providing a rigid structure comprising the vessel 10 and the floating bodies 17 when the floating dock 17 is in locking engagement with the vessel 10. It should be appreciated that during the positioning of the floating bodies 17 with respect to the vessel 10, temporary hawsers may be used on order to pull the floating bodies 17 sideways into position with respect to the vessel 10. Once a floating body 17 is in proper position along the hull side of the vessel 10, the floating body 17 may be de-ballasted and/or the vessel 10 ballasted, so that the tongue engages the groove, establishing a rigid connection.

The hull/floating dock connection 16 is configured in such way that the floating dock 17 may be quickly disconnected from the vessel 10. The connection 16 may for this purpose be of a groove and tongue type. It should be appreciated however, that the connection between the vessel and the floating dock may be of any other suitable mechanical type.

Preferably, the connection may be of a type based on thrust upwards, provided by means of buoyancy from the floating dock 17, the only thrust producing point on the vessel 10 being through the contact 16 above sea level between the vessel 10 and the floating dock 17.

Figures 4, 5:
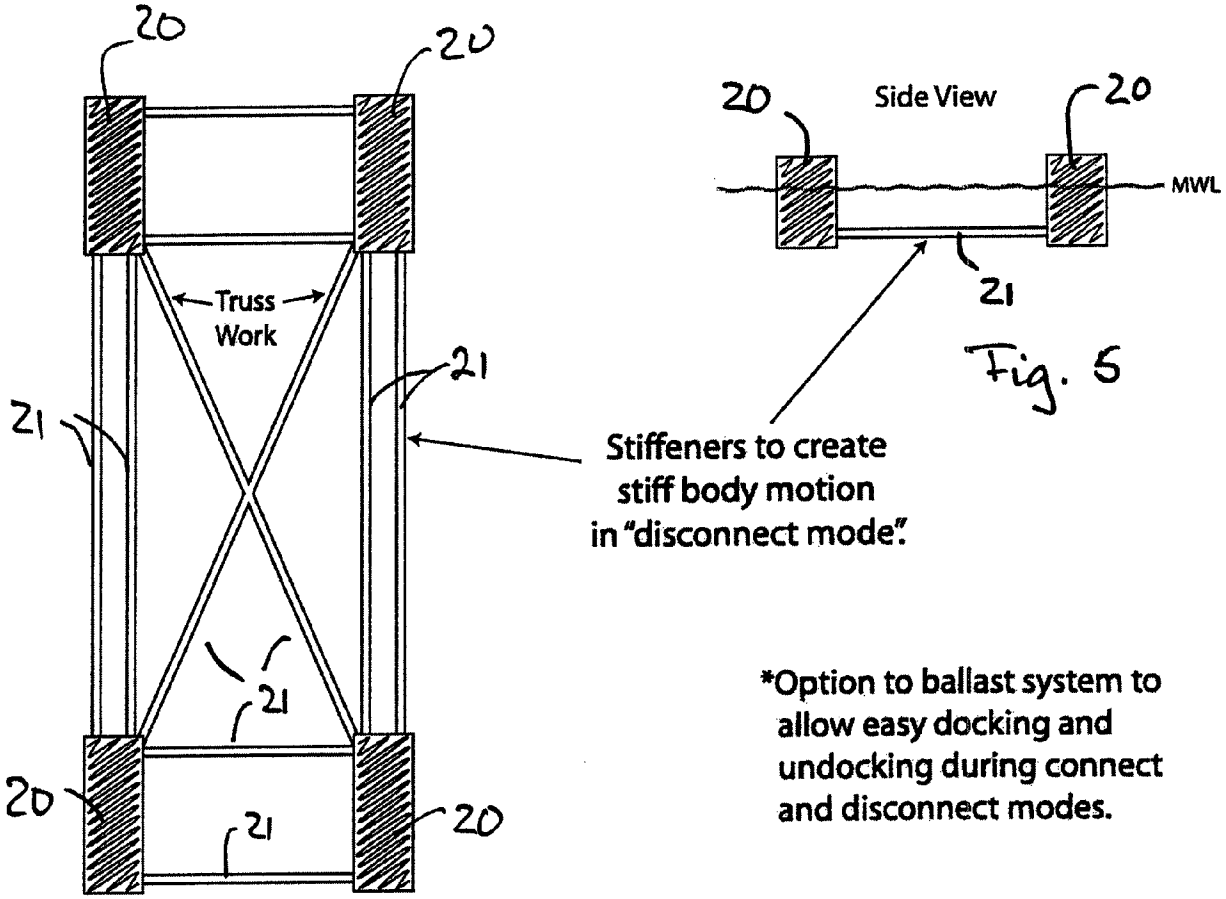
FIG. 4 shows schematically a top view of the floating dock according to the present invention.
FIG. 5 shows a side view of the floating dock shown in FIG. 4.

FIGS. 4 and 5 show schematically one embodiment of a floating dock 17, in accordance with the present invention.

The floating dock 17 comprises four buoyant bodies 20, the four bodies 20 being interconnected by means of transverse and longitudinal stiffeners or braces 21 and also of diagonally arranged trusses 19. As shown in FIG. 5, the trusses and/or braces are arranged at the lower end of the buoyant bodies 20.

According to the present invention, the idea is to use a standard FPSO hull, with local adoptions around the connection areas to handle the mooring forces. The mooring will be a compliant system allowing for partly weathervaning. The offloading system will allow for an even larger offloading sector with its turn-table. The hang-off/mooring unit may be based on the principle of the "Seadock™" system, in that case it is recommend having two units (i.e. one in bow and one in stern). Alternatively, there may be four smaller units (i.e. 2 at the bow and 2 at the stern). In both cases, the units need to be connected to form a rigid body motion.

The new elements is the combination of various systems to build a new floating production unit that allows for quick disconnection in case of extreme weather (e.g. hurricanes in Gulf of Mexico). While the various elements forming the assembled unit according to the present invention may be known per se, the combined integration and system adoption of hull design, operation, and riser/mooring hang-off unit, and offloading system are unique.

The floating body/bodies may be provided with a fendering system of any suitable type. Since such fendering systems are well known by the person skilled in the art, thus the fendering system will not disclosed or described in further details.

As shown in the Figures, the floating bodies are preferably of a type which is intended to extend under the hull and not intended to be in supporting contact with the hull bottom of the vessel.

The invention claimed is:

1. A system for mooring a vessel for production of hydrocarbons, the system for mooring the vessel comprising:

at least two floating bodies, moored by means of differentiated compliance spread anchoring system to a sea bed, allowing partly weathervaning of the vessel;

at least a riser system extending from the sea bed to each of the at least two floating bodies; and a fluid transfer system provided on each of the at least two floating bodies and configured to transfer of fluids from the two floating bodies to the vessel, the at least two floating bodies and the vessel being provided with a locking device configured to lock the at least two floating bodies to the vessel at a bow and a stern of the vessel in a mechanically rigid manner, thus providing an integrated, rigidly fixed unit comprising the vessel and the floating bodies, wherein the locking device comprises a releasable groove and tongue connection device configured to lock the at least two floating bodies to the vessel for forming a rigid motion preventing interconnection, and wherein the groove of the releasable groove and tongue connection device is arranged on the vessel and the corresponding tongue is arranged on the at least two floating bodies, the groove being open downwards and the tongue being in the form of an upwards extending fin or flange.

2. The system according to claim 1, wherein the fluid transfer system communicates with a corresponding fluid transfer system on the vessel, the fluid transfer system being of the a quick release hard pipe system provided with flanges/hinges.

3. The system according to claim 2, wherein the at least two floating bodies comprises four floating bodies, said four floating bodies being rigidly interconnected by longitudinal, transverse bracings together with a truss work interconnecting pairs of diametrically positioned floating bodies.

4. The system according to claim 1, wherein the at least two floating bodies comprises four floating bodies, said four floating bodies being rigidly interconnected by longitudinal, transverse bracings together with a truss work interconnecting pairs of diametrically positioned floating bodies.

5. A method for mooring a vessel comprising the steps of:

providing the system for mooring the vessel according to claim 1;

mooring the vessel to the at least two floating bodies, each of the at least two bodies being moored to the sea bed by means of a plurality of mooring lines, wherein the vessel is positioned in a position adjacent to or over and between the at least two floating bodies, whereupon the floating bodies are pulled in towards the vessel; and establishing a spread mooring for the vessel.

6. The method according to claim 5, further comprising de-ballasting the floating bodies when in position adjacent the vessel, moving upwards, and establishing a rigid, mechanical connection with the vessel.

* * * * *